US005839176A

United States Patent [19]

Lin

[11] Patent Number: 5,839,176

[45] Date of Patent: Nov. 24, 1998

[54] TEXTILE YARN HANGING AND BLOWING NOZZLE STRUCTURE

[76] Inventor: Sue-Ping Lin, 8F-2, No. 188, Ta Tung Road, Shan Hsia Town, Taipei Hsien, Taiwan

[21] Appl. No.: 964,202

[22] Filed: Nov. 4, 1997

[51] Int. Cl.[6] ..... D02G 1/16

[52] U.S. Cl. ..... 28/272

[58] Field of Search ..... 28/271, 272, 273, 28/274, 275, 276

[56] References Cited

U.S. PATENT DOCUMENTS

| | | | |
|---|---|---|---|
| 4,641,504 | 2/1987 | Runkel et al. | 28/272 |
| 4,691,947 | 9/1987 | Burkhardt et al. | 28/272 |
| 5,146,660 | 9/1992 | Riter | 28/274 |
| 5,575,049 | 11/1996 | Gorrafa et al. | 28/272 |
| 5,713,113 | 2/1998 | Demir | 28/274 |

FOREIGN PATENT DOCUMENTS

| | | | |
|---|---|---|---|
| 916623 | 4/1982 | U.S.S.R. | 28/272 |

*Primary Examiner*—Michael A. Neas
*Assistant Examiner*—Larry D. Worrell, Jr.
*Attorney, Agent, or Firm*—Bacon & Thomas

[57] ABSTRACT

Yarn hanging and blowing nozzle structure, comprising mainly a hollow housing in which is a fixed block, at one end of the fixed block is an air inlet, on top of the fixed block are a movable first slide block and a second slide block, between the two slide blocks is a driving mechanism, for moving the first and the second slide blocks in opposite directions, a block piece located in the housing corresponding to the air inlet of the fixed block and between the two slide blocks, the block piece having an air hole that communicates with the air inlet; so, before blowing air on the yarns, the yarns are hanged on the block piece, the first and the second slide blocks are respectively driven to move in opposite directions, so the air inlet communicates with the air hole, and the block piece is obstructed by the second slide block, so the compressed air is blown directly onto the yarns, thus the operator needs only move the two slide blocks to expose the block piece outside the housing for either yarn hanging process or for cleaning purpose on the block piece.

8 Claims, 9 Drawing Sheets

TEXTILE YARN HANGING AND BLOWING NOZZLE STRUCTURE

BACKGROUND OF THE INVENTION

The subject invention relates to a type of textile yarn hanging and blowing nozzle structure, particularly to one that enables convenient operation in hanging the yarns.

Conventionally, a textile yarn hanging and blowing nozzle structure, as illustrated in FIGS. 8 and 9, comprises a lifting unit 1, a U-shaped unit 20 and a linked unit 3, wherein:

A lifting unit 1, a square shape cap cover, one side is cut hollow, on the inside at the front edge is a depression 11 to accommodate an upper ceramic piece 12, and at the other end are two holes 13, on the two sides in the hollow are protruding pieces 14 with appropriate length;

A U-shaped unit 20, in a depression at an appropriate location on its top side is an accommodating channel 21, which is an opening, to accommodate a middle ceramic piece 22, on the bottom side is a depressed guide rail 23, on top of two sides at the top is respectively a slide channel 231, that can be inserted from the opening on the lifting unit 1 onto the protruding piece 14 which will move to and fro, and at one side of the guide rail 23 is an opening 232, on which is fastened a stop piece 233 that serves to stop the lifting unit 1 when it is lifted, on the lower side inside the unit is a slide groove 234;

A linked unit 3, in the shape of a rectangle, on two sides are protruding guide pieces 31 each with an appropriate length extending outward, which can be accommodated and moving in the slide groove 234 on the bottom side below the guide rail 23 inside the U-shaped unit 20, above it is a depressed groove (not shown in Drawing), with a penetrating screw hole 33 to fasten the lower ceramic piece 34 which is joined by a screw to a socket 35;

By lifting the lifting unit 1, the U-shaped unit 20 and the linked unit 3 will be moved in sequence, it involves the feature that the yarns can be easily put in place, and with the adjustment of the turning socket 35, the ceramic pieces 12, 22 and 34 can be pushed tight, to properly control the tightness when the lifting unit is sliding.

However, the conventional technology involves more sophisticated construction that causes more difficult production process and more expensive production costs, meanwhile, conventional technology involves inconvenience in its assembling procedures or applications.

SUMMARY OF THE INVENTION

The primary objective of the subject invention is to present a type of textile yarn hanging and blowing nozzle structure, comprising mainly a fixed block installed in a hollow housing, one end of the fixed block has an air inlet, and on top of the fixed block are a first slide block and a second slide block, between the two slide blocks is a driving mechanism, said driving mechanism will drive the first and the second slide blocks to move in opposite directions, and, inside the housing corresponding to the air inlet on the fixed block and between the two slide blocks is a block piece, on said block piece is an air hole that communicates with the air inlet; so designed that, before blowing air on the yarns, the yarns are hanged onto the block piece, then, the first and the second slide blocks move in opposite directions, so the air inlet communicates with the air hole on the block piece, with the block piece obstructing the second slide block, so the compressed air will be blown directly onto the yarns, and since the operator needs only move the two slide blocks to expose the block piece out of the housing for yarn hanging and cleaning purposes on the block piece, its operation will be very convenient.

To enable better understanding of the structural characteristics and performance of the subject invention, preferred embodiments will be described in detail, along with the drawings:

DETAILED DESCRIPTION OF THE PREFERRED EMBODIMENTS

Figure 1:
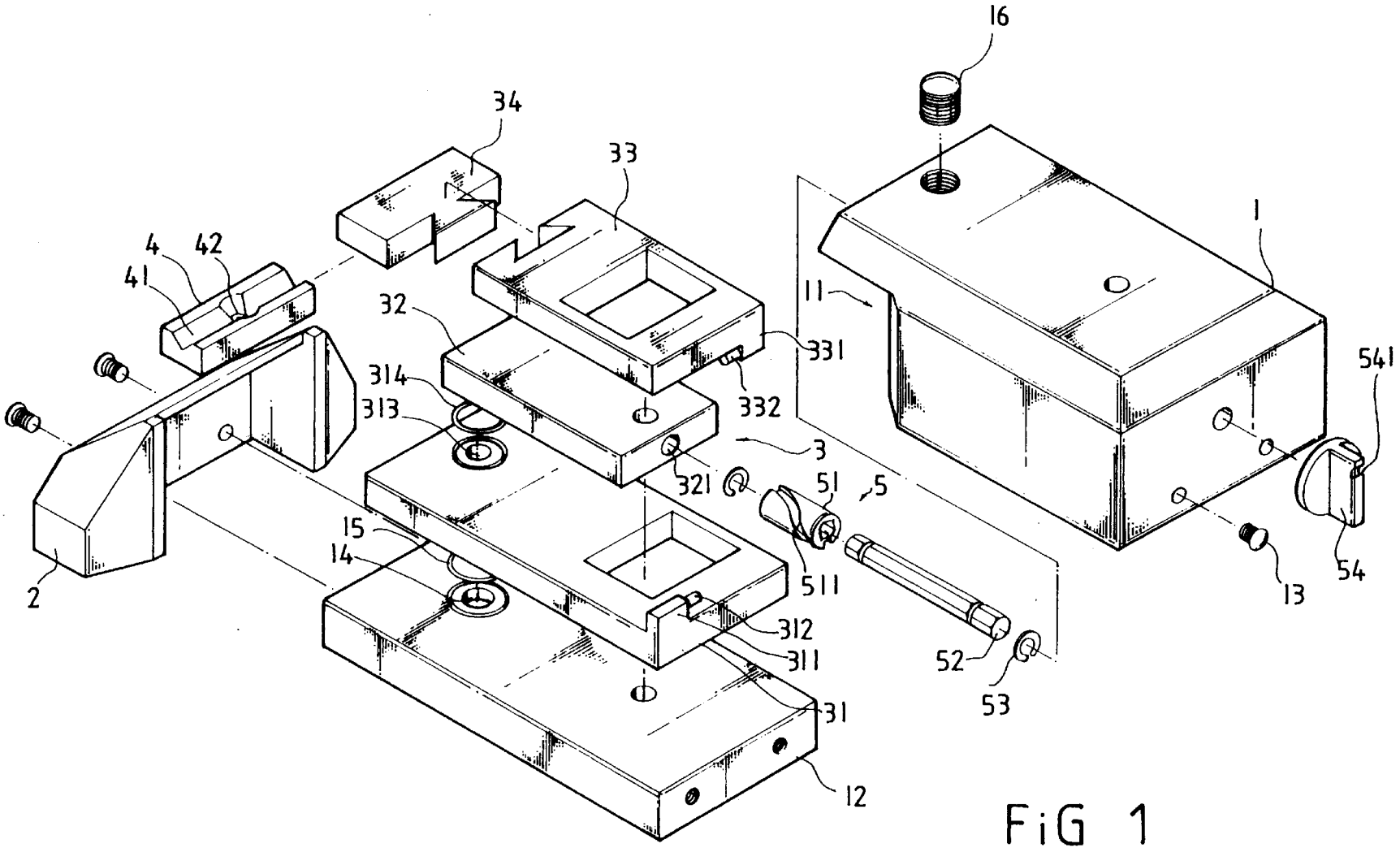
FIG. 1 is an exploded view of the first embodiment of the subject invention.
Figure 2:
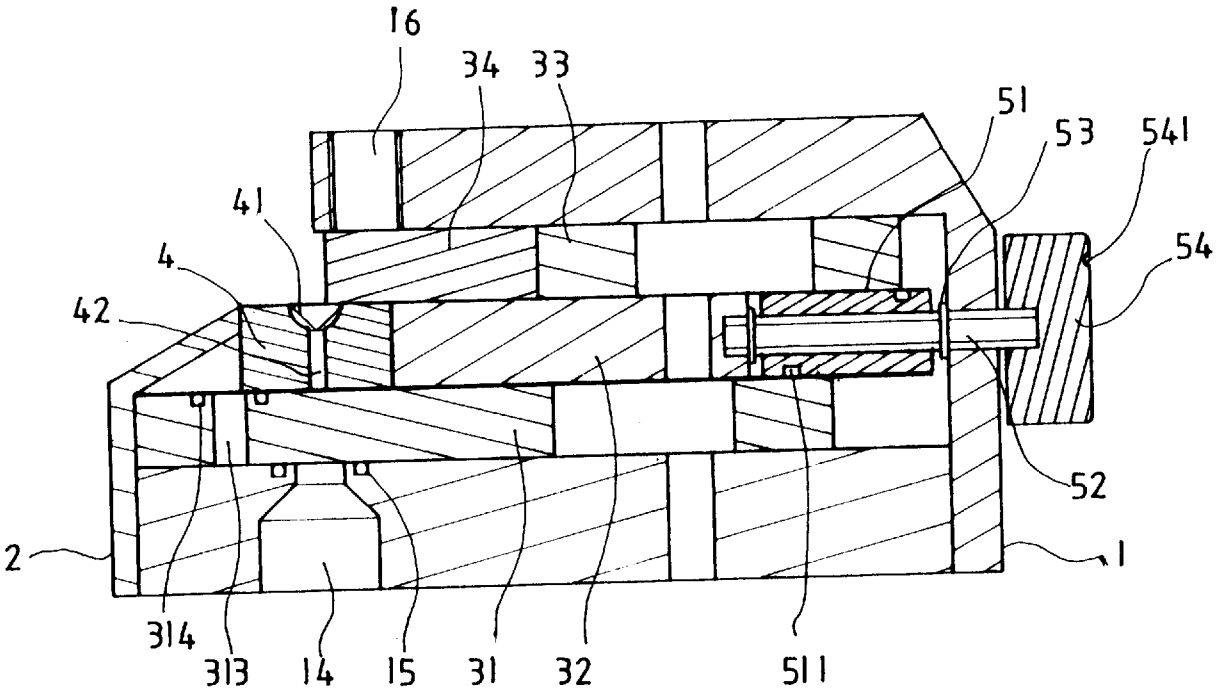
FIG. 2 is an assembled side section view of the first embodiment of the subject invention.

Please refer to FIGS. 1 and 2, the subject invention relates to a type of "yarn hanging and blowing nozzle structure" comprising mainly a hollow housing 1, one side of said housing 1 having an opening 11, onto the opening 11 is fixed with a cover 2, yet the opening 11 is not covered completely, inside the housing 1 is a fixed block 12, said fixed block 12 is tightened on two sides of the housing 1 by the fixing component 13, at one side on the fixed block near the opening 11 of the housing 1 is a through air inlet 14, said air inlet 14 communicates to an outside compressed air equipment, to allow the entrance of compressed air, and on top of said air inlet 14 is a washer 15 that will achieve air-tight effect.

In the subject invention, on top of the fixed block 12 in the housing 1 is a slide mechanism 3, said slide mechanism comprises a first slide block 31, one side at one end of said first slide block is extending upward to form a protruding piece 311, on the protruding piece 311 is a protruding post 312, while on the other side is a through air channel 313, said through air channel 313 communicates with the air inlet 14 on the fixed block 12, over said air channel 313 is also a washer 314, furthermore, on top of the first slide block 31 is a middle plate 32, the size of said middle plate 32 is slightly smaller than the size of the first slide block 31, and, on top of the middle plate 32 is a second slide block 33, on a position at one side of said second slide block 33 opposite to the protruding piece 311 on the first slide block 31 is also an extended protruding piece 331, on the protruding piece 331 is a protruding post 332, said two protruding posts 312 and 332 are kept at a specified distance, in this example of embodiment, the other end of the second slide block 33 is dovetailed with a pressing block 34, said pressing block 34 corresponds to the air channel 313 on the first slide block 31, the top side of the pressing block 34 is pressed by the bolt 16 that is tightened on top of the housing 1 and pressing downward, and a clearance is reserved between it and the first slide block 31.

Figure 3:
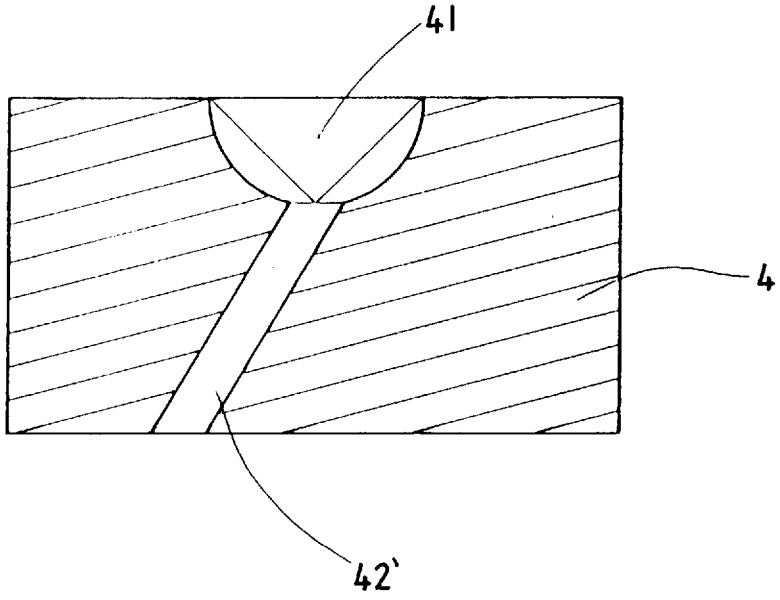
FIG. 3 is an illustration of another embodiment of the block piece in the subject invention.

In the subject invention, there is a block piece 4, said block piece 4 is made of ceramic, it is inserted in the clearance between the pressing block 34 and the first slide block 31, it is on the same level with the middle plate 32, on said block piece 4 is a V-channel 41, on the V-channel 41 is a through air hole 42, said air hole 42 communicates with the air channel 313 on the first slide block 31. In this example of embodiment, said air hole 42 is perpendicular to the V-channel 41, or as shown in FIG. 3, said air hole 42' may be inclined at an angle to communicate with the V-channel 41, by the angle of inclination, the yarn blowing effect may be enhanced; so designed that, when the textile yarn is hanged onto the V-channel 41 on the block piece 4, compressed air is delivered from the air inlet 14 on the fixed block 12 through the air channel 313 on the first slide block 31, to the air hole 42 on the block piece 4, to blow onto the yarns.

In the subject invention, between the first slide block 31 and the second slide block 33 is a driving unit 5, said driving unit 5 comprises a hollow shaft sleeve 51, said hollow shaft sleeve 51 is fitted onto a joining rod 52, its two ends are each respectively clamped by a C-clamp 53 onto the joining rod 52, while one end of the joining rod 52 is inserted into the joining hole 321 on the middle plate 32, and the other end extends out of the housing 1 to be fixed with a turning knob 54, on said turning knob 54 is a vent 541 that serves as a marking to determine whether the first and the second slide blocks 31 and 33 have moved or not, furthermore, on the outside of said shaft sleeve 51 is a spiral shaped slide channel 511, the protruding post 312 and 332 respectively located on the first and the second slide blocks 31 and 33 are accommodated in the two ends of said slide channel 511, so when the turning knob 54 is turned, the protruding posts 312 and 332 on the first slide block 31 and the second slide block 33 will be moved with the movement of the slide channel 511, then the first and the second slide blocks 31 and 33 will move separately in opposite directions.

Please refer to FIG. 2, to perform the yarn hanging operation, the yarns are hanged onto the V-channel 41 on the block piece 4, and since the opening of the housing 1 is not completely covered by the cover 2, and the pressing block 34 has not yet moved to above the block piece 4, so, the block piece 4 will be exposed on the outside, and the air channel 313 on the first slide block 31 has not yet communicated with the air inlet 14 on the fixed block 12, so the compressed air could not flow onto the block piece 4.

Figure 4:
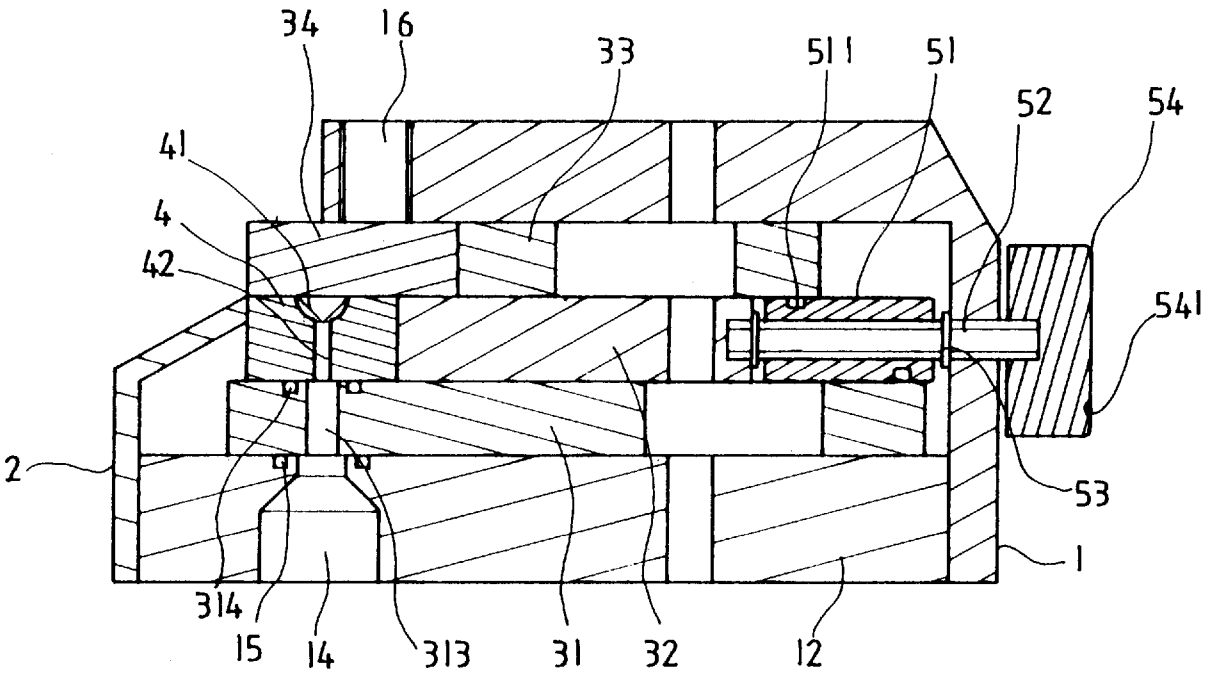
FIG. 4 is an illustration of the first embodiment of the subject invention in operation.

Please refer to FIGS. 1 and 4, to blow compressed air onto the yarns on the block piece 4, turn the turning knob 54 to rotate the shaft sleeve 51 on the joining rod 52, so the protruding posts 312 and 332 on the first slide block 31 and the second slide block 33 will move along the slide channel 511, since the first and the second slide blocks 31 and 33 are respectively located at two ends of the slide channel 511, the first and the second slide blocks 31 and 33 will move in opposite directions, then, since the first and the second slide blocks 31 and 33 move in opposite directions, the first slide block 31 will move to the right, so the air channel 313 on the first slide block will communicate with the air inlet 14 on the fixed block 12 and with the air hole 42 on the block piece 4, meanwhile, the second slide block 33 will move to the left, so the pressing block 34 at the end of the second slide block 33 will be positioned above the block piece 4, obstructing the air hole 42, then the compressed air is blown into the air inlet 14 on the fixed block 12, through the air channel 313 on the first slide block 31, and into the air hole 42 in the block piece 4, and onto the yarns, without leaking to the outside, thus, the textile yarn blowing operation is accomplished.

To prevent air leak at the air inlet 14, the air channel 313 and the air hole 42 in the subject invention, in addition to the washers 15 and 314 fitted respectively onto air inlet 14 and the air channel 313, the bolt 16 is screwed to extend downward to push on the pressing block 34, so the block piece 4 and the first slide block 31 can be pressed tightly together, but if the bolt 16 is directly pushed against the second slide block 33, it will cause inclination on one end of the second slide block 33, therefore, the end of the second slide block 33 is dovetailed with a pressing block 34, so the bolt 16 is screwed and extending down to push against the pressing block 34, the second slide block 33 will slide smoothly without any inclination.

Figure 5:
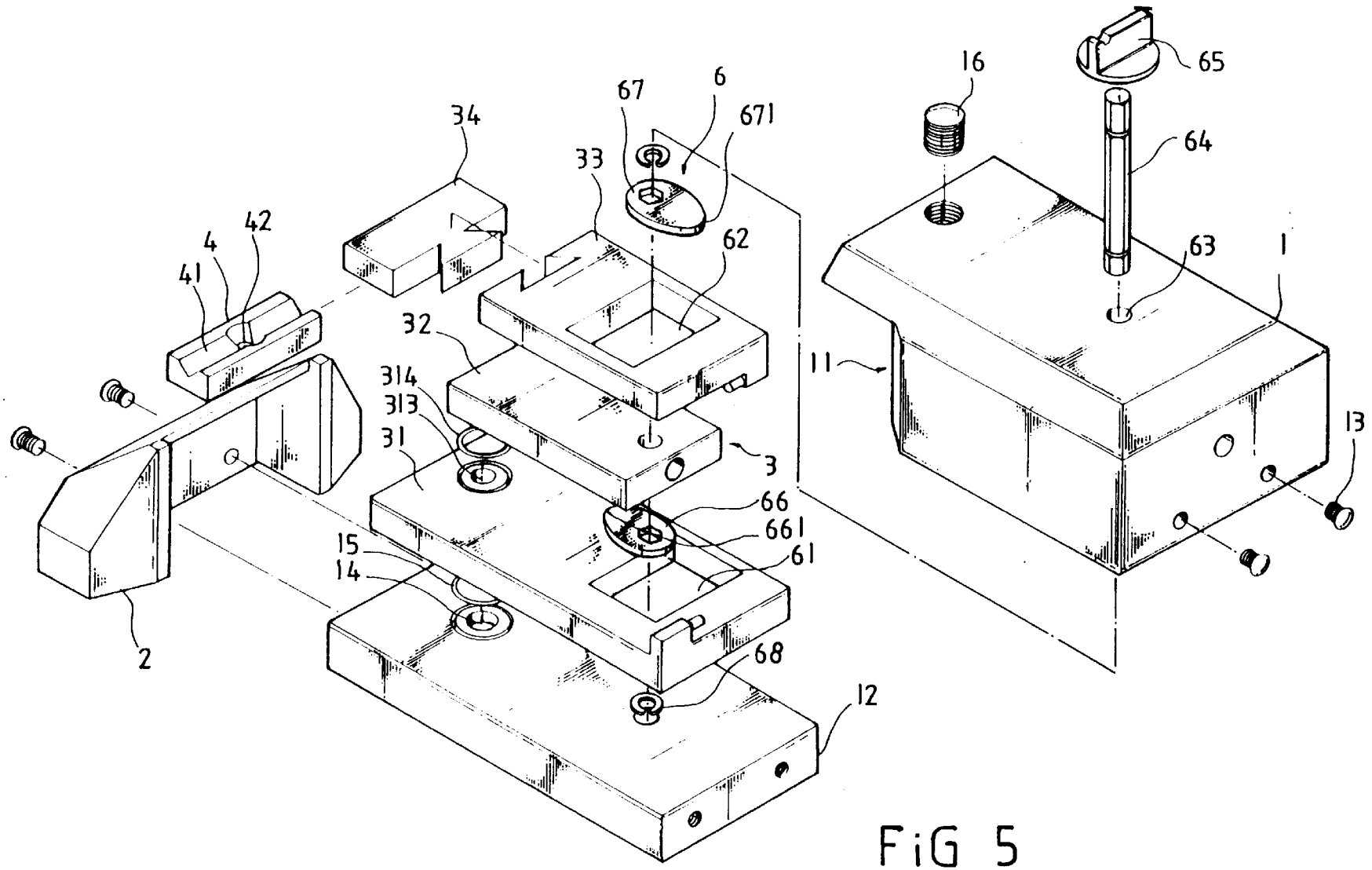
FIG. 5 is an exploded view of the second embodiment of the subject invention.
Figure 6:
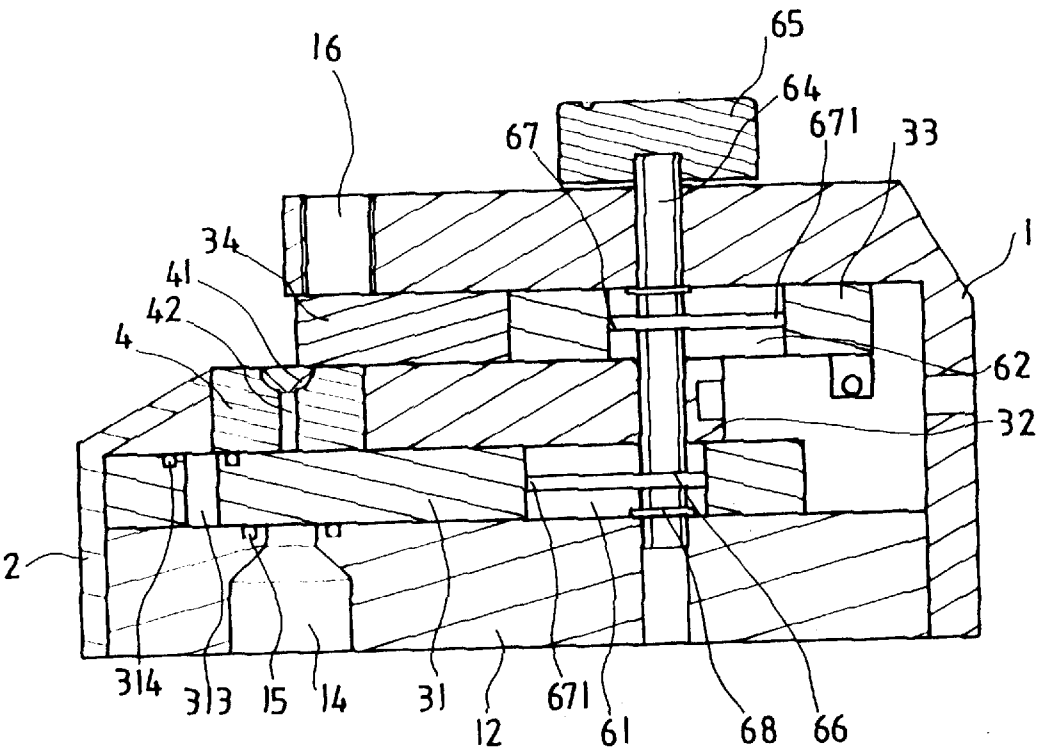
FIG. 6 is an assembled side section view of the second embodiment of the subject invention.

Please refer to FIGS. 5 and 6 which illustrates the second example of embodiment of the subject invention, wherein, at the sides of said first slide block 31 and the second slide block 33, away from the block piece 4, are respectively the openings 61 and 62 that are aligned to each other, and on the top side of the housing 1 corresponding to the positions of the openings 61 and 62 is another hole 63, besides, said driving unit 6 includes a joining rod 64, said joining rod 64 penetrates the hole 63 on the housing and through the openings 61 and 62 on the first and the second slide blocks 31 and 33, said joining rod 64 extending out of the top of the housing 1 is fitted to a turning knob 65, at the openings 61 and 62 of the two slide blocks 31 and 33 there are respectively the eccentric cams 66 and 67, said two eccentric cams 66 and 67 are positioned onto the joining rod 64 by C-clamps 68 from the outsides nearer to the two ends, the lobes 661 and 671 of the two eccentric cams 66 and 67 are arranged in opposite directions, while the construction of other components remain the same as the first example of embodiment.

Figure 7:
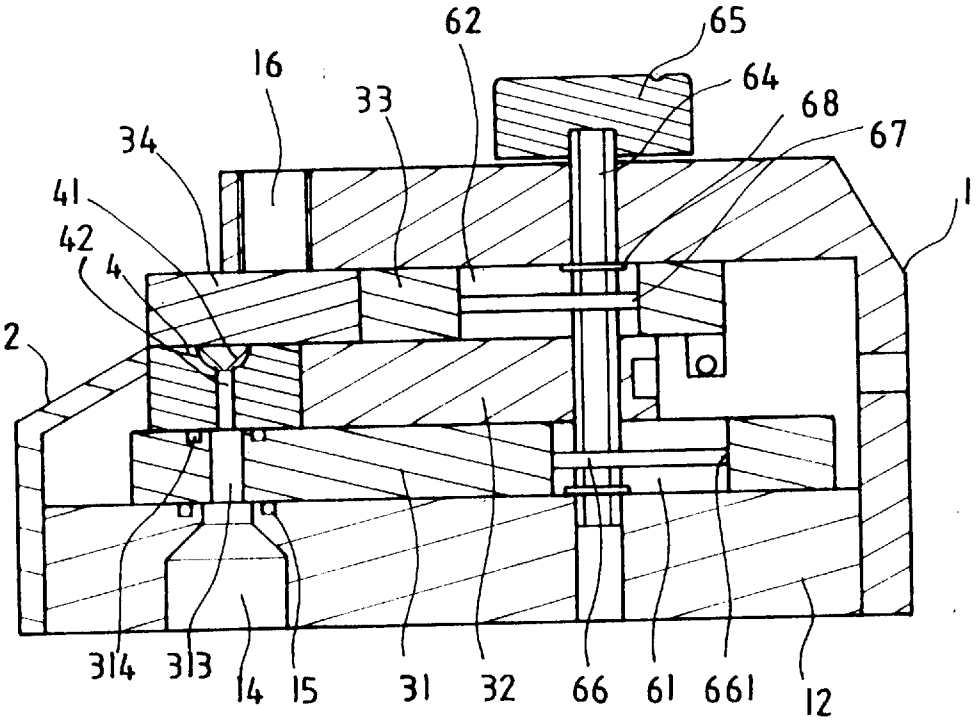
FIG. 7 is an illustration of the second embodiment of the subject invention in operation.
Figure 8:
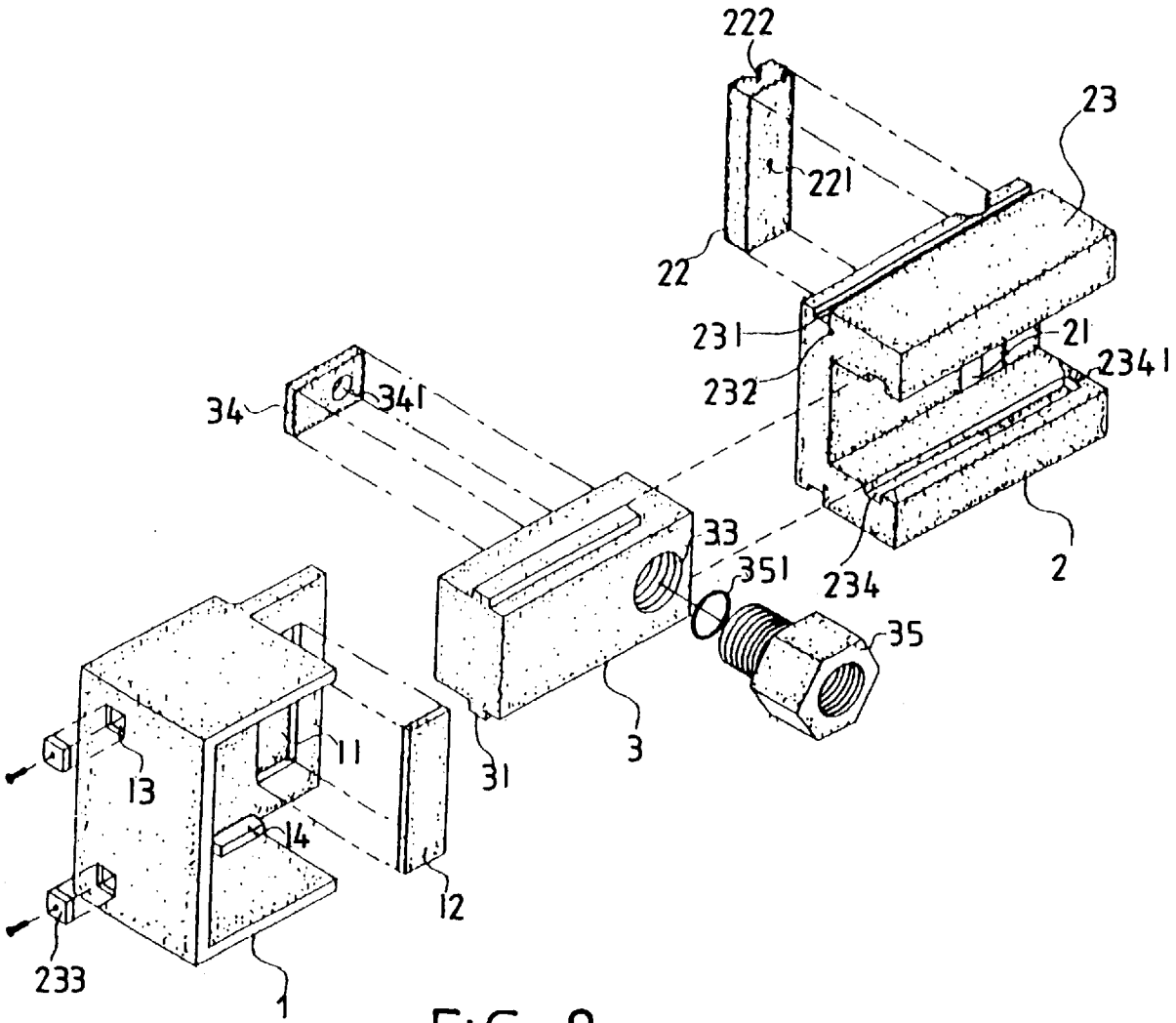
FIG 8 PRIOR ART
FIG. 8 is an exploded view of a prior art device.
Figure 9:
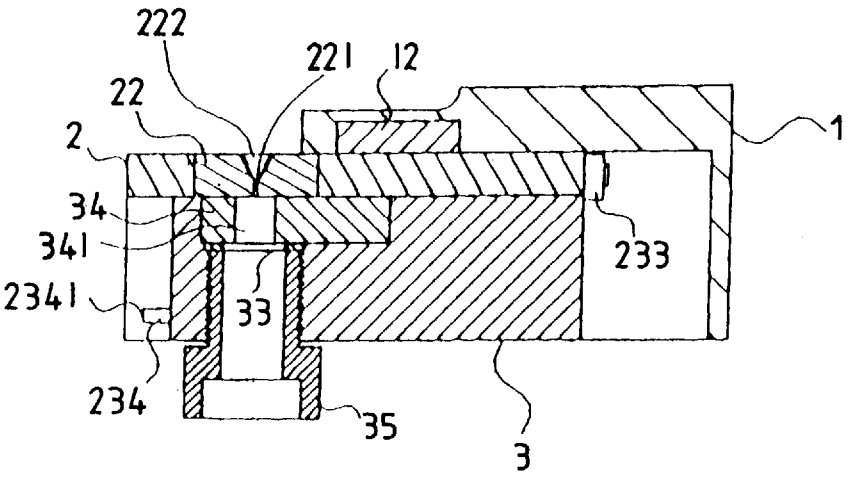
FIG 9 PRIOR ART
FIG. 9 is an assembled side section view of a prior art device.

Please refer to FIG. 7, to blow compressed air onto the yarns on the block piece 4, turn the turning knob 64 to rotate the two eccentric cams 66 and 67 on the joining rod 64, then, the lobes 661 and 671 of the two eccentric cams 66 and 67 will push the two slide blocks 31 and 33 to move, since the lobes 661 and 671 of the two eccentric cams 66 and 67 are arranged in opposite directions, the first and the second slide blocks 31 and 33 will also move in opposite directions, the first slide block 31 will move to the right, so the air channel 313 on the first slide block 31 will communicate respectively with the air inlet 14 on the fixed block 12 and the air hole 42 on the block piece 4, meanwhile, the second slide block 33 will move to the left, so the pressing block 34 at one end of the second slide block 33 will be positioned above the block piece 4, obstructing the air hole 42, so compressed air enters from the air inlet 14 on the fixed block 12, through the air channel 313 on the first slide block 31, into the air hole 42 on the block piece 4, and onto the yarns, without any air leak, thus the textile yarns blowing operation is accomplished.

Summing up, by means of the construction of the subject invention, the operator will not have to disassemble the components when he or she is operating the yarn hanging operation or cleaning the block piece 4. All the operator has to do is perform the yarn hanging or cleaning job directly on the block piece 4, so it is quite convenient in its operation. The unsophisticated construction of the subject invention is more simplified than the previous application filed by the subject inventor. With easy operation in production and assembling processes, it will be able to significantly save the production costs. Therefore, it is indeed an ideal construction.

It is declared hereby that the above examples of embodiment have been cited to describe the feasible examples of embodiment of the subject invention, and that all equivalent structural and/or configurational variations and/or modifications easily conceivable to anyone skilled in the subject art shall reasonably be included in the intent and scope of the subject claims.

I claim:

1. A type of textile yarn blowing nozzle structure, comprising:

a hollow housing, one side of said housing having an opening, at the opening being fixed a cover which does not completely seal the opening;

a fixed block, the block being fixed onto the housing by a fixing component, a through air inlet on one side of said fixed block near the opening of the housing, the air inlet for communicating with an outside compressed air equipment for receiving compressed air into the inlet;

a slide mechanism located inside the housing, said slide mechanism comprising a first slide block having a movable through air channel, said air channel being aligned and communicating with the air inlet on the fixed block, a middle plate on top of the first slide block, the middle plate being slightly smaller than the first slide block, and a movable second slide block on top of the middle plate;

a block piece fitted between the first slide block and the second slide block, the block piece on the same side with the air channel of the first slide block, a V-channel on the block piece, the V-channel having a through air hole, said air hole communicating with the air channel on the first slide block, so that textile yarns may be hanged onto the V-channel of the block piece;

a driving mechanism, being located at the side of the housing and spaced from the block piece, and joined respectively with the first slide block and the second slide block, said driving mechanism serving to drive the first slide block and the second slide block inside the housing to move in opposite directions; and whereby before blowing air onto the yarns, the yarns are hanged onto the V-channel on the block piece, and the driving mechanism will drive the first and the second slide blocks to move in opposite directions, so that the air inlet, the air channel and the air hole are aligned to and communicating with the air hole on the block piece, while the block piece is obstructed by the second slide block, so that the compressed air will be blown directly onto the yarns.

2. The yarn hanging and blowing nozzle structure, as recited in claim 1, wherein, a washer is fitted respectively on top of the air inlet of said fixed block and on the air channel of the first slide block, to achieve an air-tight effect.

3. The yarn hanging and blowing nozzle structure, as recited in claim 1, wherein, said driving mechanism includes a hollow shaft sleeve, said hollow shaft sleeve is fitted onto a joining rod having a pair of ends, each end being positioned by a C-clamp, one end of the joining rod is inserted in a joining hole at one side of the middle plate, the other end is joined with a turning knob, the sleeve includes an exterior spiral shaped slide channel, a side of the first slide block includes an extension of a first protruding piece, a first protruding post on said first protruding piece, the second slide block includes a downward extension of a second protruding piece on which is a second protruding post, the first and second protruding posts are spaced from each other, the protruding posts on the first and the second slide blocks are respectively located at two ends of said slide channel, so that when the turning knob is rotated, the protruding posts on the first and the second slide blocks will move along the slide channel and cause the first and second slide blocks to move in opposite directions.

4. The yarn hanging and blowing nozzle structure, as recited in claim 1, wherein, the end of said second slide block corresponding to the block piece is dovetailed with a pressing block, and the top side of the pressing block is pushed by a bolt that extends down the top side of the housing.

5. The yarn hanging and blowing nozzle structure, as recited in claim 1, wherein, the air hole on said block piece is inclined at an angle and communicating with the V-channel.

6. The yarn hanging and blowing nozzle structure, as recited in claim 1 or 4 or 5, wherein, said block piece is made of ceramic.

7. The yarn hanging and blowing nozzle structure, as recited in claim 1, wherein, said driving mechanism includes a first opening in the first slide block and a second opening in the second slide block the openings being spaced from the block piece, and a hole in a top of the housing corresponding to the openings, a joining rod, the joining rod is inserted through the hole in the housing and through the openings in the first and the second slide blocks, said joining rod having an end extending out of the top of the housing and joined to a turning knob, an eccentric cam is fitted on the joining rod at the opening of each of the two slide blocks, the two eccentric cams are positioned by a pair of C-clamps on the joining rod, the lobes of the two eccentric cams are positioned in opposite directions for pushing the first slide block and the second slide block in opposite directions upon rotation of the knob.

8. The yarn hanging and blowing nozzle structure, as recited in claim 3 or 7, wherein, on said turning knob is a vent that serves as a marking to indicate whether or not the first and the second slide blocks have moved.

* * * * *